United States Patent [19]

Peterson

[11] 4,068,507

[45] Jan. 17, 1978

[54] LIMITED ACCESS LOCK

[75] Inventor: Francis C. Peterson, St. Louis County, Mo.

[73] Assignee: C. Hager & Sons Hinge Manufacturing Company, St. Louis, Mo.

[21] Appl. No.: 713,275

[22] Filed: Aug. 11, 1976

[51] Int. Cl.[2] ..... E05B 27/04; E05B 43/00

[52] U.S. Cl. ..... 70/271; 70/337; 70/364 A

[58] Field of Search ..... 70/271, 337, 358, 364 A, 70/378, 419, 421, 262–267, 274, 277, 279, 283, 268–270

[56] References Cited

U.S. PATENT DOCUMENTS 3,670,538 6/1972 Curry ..... 70/271

*Primary Examiner*—Robert L. Wolfe

*Attorney, Agent, or Firm*—Gravely, Lieder & Woodruff

[57] ABSTRACT

A lock has a lock cylinder provided with a rotatable core which is normally prevented from rotating by drivers that bridge the shear line between the core and the main body of the cylinder. However, when either first or second keys are inserted into the core, pins within the core are elevated to the shear line so that the drivers no longer prevent rotation of the core. The main body of the cylinder also contains a push rod which is urged into the core by an actuator when the actuator is energized, but is otherwise located out of the core with its inner end flush with the shear line. The core also contains a pin which aligns with the push rod. The first key is incapable of moving the push rod out of the core so that the core may be turned with the first key only when the actuator is de-energized. The second key, however, forces the pin associated with the push rod against the push rod and moves the push rod outwardly to the shear line, even when the actuator is energized. Thus, the second key will rotate the core irrespective of whether or not the actuator is energized.

13 Claims, 7 Drawing Figures

FIG. 1
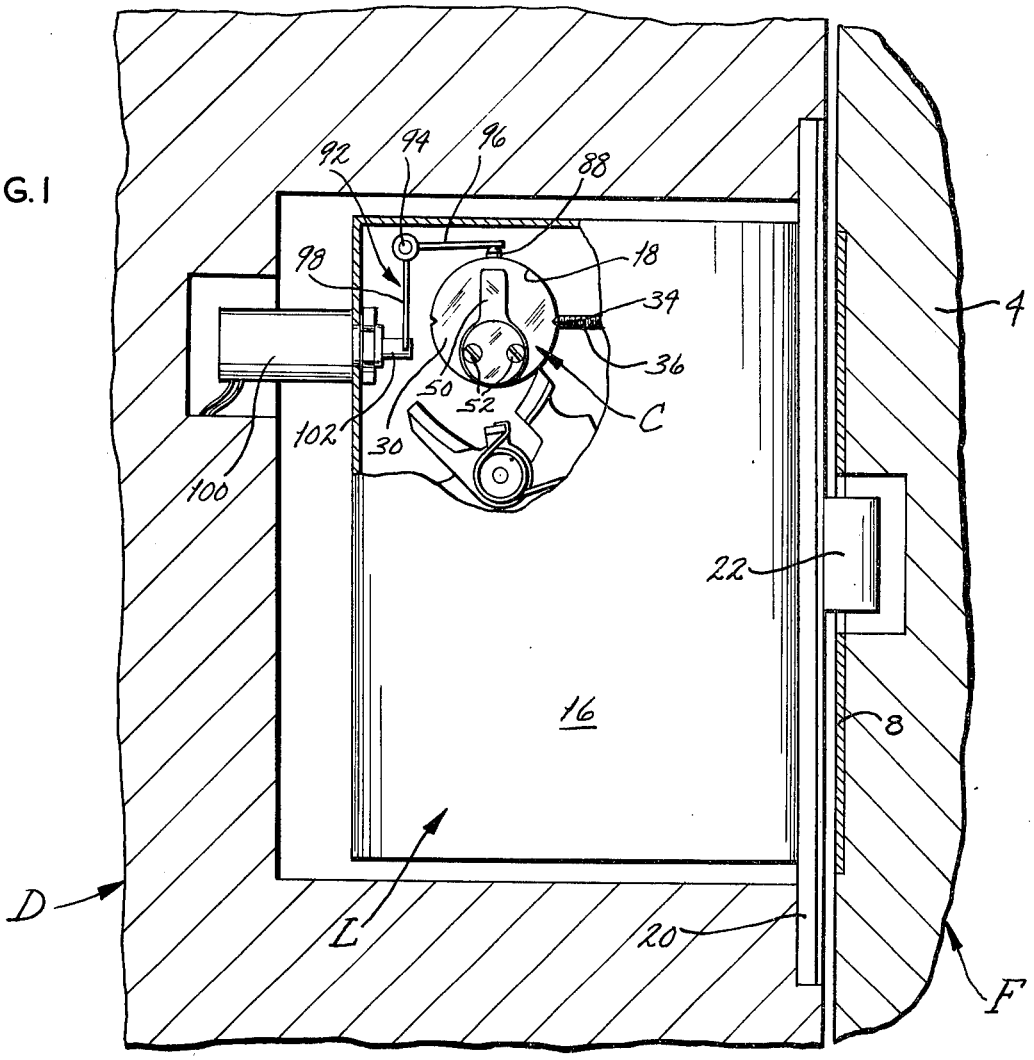
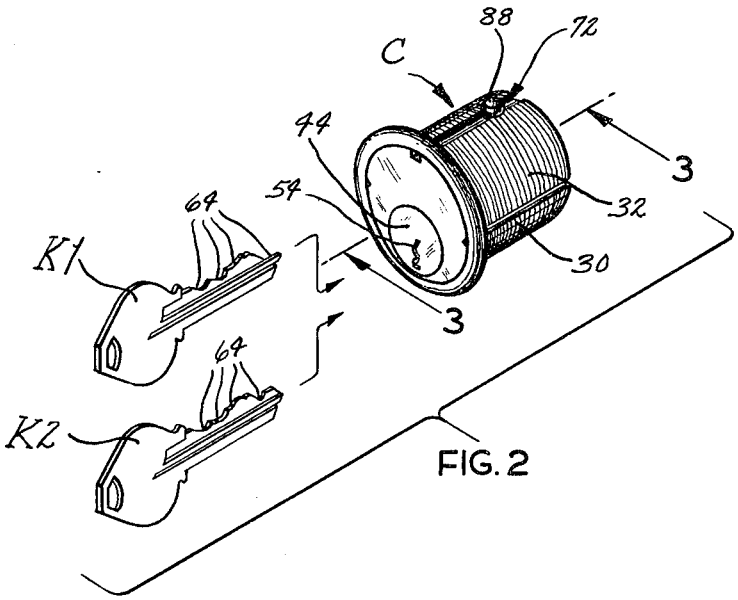
FIG. 2

LIMITED ACCESS LOCK

BACKGROUND OF THE INVENTION

This invention relates in general to locks and more particularly to a key-operated lock which is normally operable by a specific key but may be rendered inoperable as to that key.

Most locks are key-operated, and any person having the proper key may operate the lock to gain access to the area normally secured by it. In some applications it is desirable to have the lock operable by the key at certain times and not operable by that key at other times. For example, some penal institutions assign each inmate a separate cell, yet provide the inmate with a key to that cell, but not to the cell block as a whole, so that the inmate has free acess to the cell block and the various facilities in it. This provides the inmate protection for his personal possessions, and also enable him to remain apart from other inmates if he so desires. Yet there are certain times, such as during periods of rest or disturbances, when the inmates must be confined to their own cells. Hence, the locks on the individual cells must in some way be secured during these periods so that they can no longer be operated by the inmates' keys. Even so, the security personnel must have access to the cells during these periods. Locking arrangements of current design do not provide these capabilities with any degree of simplicity and economy.

A locking arrangement having the foregoing capabilities is useful in other types of buildings. One type of building which would be more easily administered with such a locking arrangement is the typical college dormitory. The student residents of these buildings are provided with keys to the main doors, but the locks cannot be operated by the keys during certain periods of the day.

SUMMARY OF THE INVENTION

One of the principal objects of the present invention is to provide a key-operated lock which may be set from a remote location such that the key for the lock will not operate the lock. Another object is to provide a lock of the type stated which may be operated by another or master key when it is set such that it cannot be operated by its normal key. A further object is to provide a lock of the type stated which may be constructed from a conventional lock by making relatively simple modifications thereto. An additional object is to provide a lock of the type stated which is simple in construction and economical to manufacture. These and other objects and advantages will become apparent hereinafter.

The present invention is embodied in a lock having a member provided with a bore in which a core is located, and the core when turned releases the lock. First means in the body prevent the core from rotating except when a key is inserted into the core. Second means in the body prevent the core from rotating irrespective of whether or not the key is in the core. The invention is also embodied in a lock cylinder having the usual pins and drivers which are brought to the shear line by both first and second keys and also having a push rod which is operated by an actuator and is capable of being projected into the core to prevent rotation thereof. The push rod is moved out of the core by the second key but not the first key, so that the lock, by control of the actuator, may be rendered inoperative as to the first key. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a section view of a door provided with a lock constructed in accordance with the present invention, the lock being partially broken away and in section to show the lock cylinder and actuating mechanism thereof;

FIG. 2 is a perspective view of the lock cylinder and the two keys which operate it;

DETAILED DESCRIPTION

Figure 3:
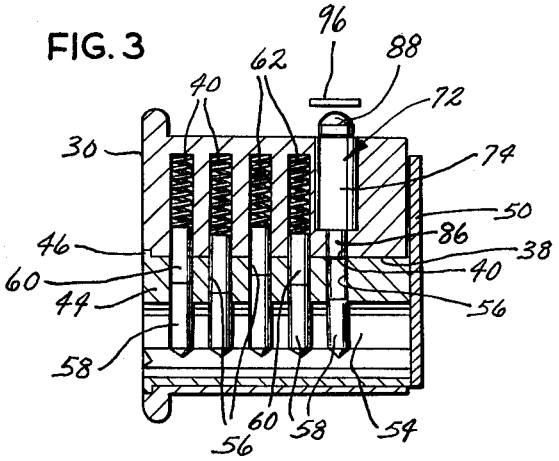
FIG. 3 is a sectional view taken along line 3—3 of FIG. 2 and showing the lock cylinder in section with the push rod thereof retracted.

Referring now to the drawings, a door D (FIG. 1) is mounted on a door frame F and normally closes the door opening defined by the frame F. Along one of its sides the frame F has a hinge jamb (not shown), while along the other side it is provided with a strike jamb 4. The door D is mounted on the hinge jamb by hinges (not shown) and may be secured in its closed position by a lock L which engages a keeper or strike 8 on the strike jamb 4.

The lock L is preferably of the mortise variety and has a case 16 (FIG. 1) which is set into a recess or mortise in the side edge of the door D. The case 16 has a threaded bore 18 near its upper end, and is attached to a mounting plate 20 which is fastened to the door D flush with the free edge thereof. The lock L contains a bolt 22 which moves between extended and retracted positions relative to the plate 20. When in the extended position, the bolt 22 projects beyond the mounting plate 20 and will enter the strike 8 on the strike jamb 4 so as to secure the door D in its closed position. When, the bolt 22 is in its retracted position, its end is generally flush with the mounting plate 20 so that the door D may be opened. The bolt 22 is controlled by a lock cylinder C which is mounted in the threaded bore 18 of the case 16 and has its end exposed on the exterior surface of the door D.

The cylinder C includes a cylindrical member or body 30 (FIG. 2) having threads 32 on its exterior surface, and these threads mesh with the threads of the threaded bore 18 in the case. Along its side the body 30 has an axially extending groove 34 and this groove receives the end of a set screw 36 (FIG. 1), the head of which is exposed through the mounting plate 20 where the screw 36 may be turned. The set screw 36, when turned down, enters the groove 34 and prevents the cylinder C from turing within the case 2.

The cylinder C contains an axial bore 38 (FIG. 3) which extends from one end of the cylindrical body 30 to the other and is offset below the center axis of the body 30. Opening into the bore 38 from above are a plurality of radial bores 40 which are all aligned in the sense that their axes are parallel and lie in a plane which passes through the center axis of the bore 38 as well as through the center axis of the cylindrical body 30. The radial bores 40 are of equal diameter, and that diameter is quite a bit smaller than the diameter of the axial bore 38.

The axial bore 38 contains a cylindrical core 44 (FIG. 3) which at its forward end is provided with an integrally formed flange 46 and at its other end is fitted with an actuating tab 50, the tab 50 being held against the end of the core 44 by machine screws 52 (FIG. 1). The fit between the bore 38 and the core 44 is such that the latter is capable of rotating freely within the former with very little if any lateral motion. This rotation causes the actuating tab 50 to move a mechanism within the lock L and that mechanism operates the bolt 22. Thus, rotation of the core 44 will retract the bolt 22. The flange 46 and tab 50 prevent axial movement of the core 44, but do not impede rotational movement.

The core 44 is provided with an axially extending keyway 54 (FIG. 3) of irregular cross-sectional shape and a plurality of radial bores 56 which extend between the keyway 54 and the cylindrical surface of the core 44. The spacing between the bores 56 equals the spacing between the radial bores 40 in the cylindrical body 30 and indeed when the core 44 is rotated to the proper position, the radial bores 56 in it align with the radial bores 40 in the body 30. Moreover, the diameters of the bores 40 and 56 are equal.

Each bore 56 of the core 44 contains a pin 58 (FIG. 3) which is shorter than the length of the bore 56 so that the pins 58 normally do not extend up to the cylindrical surface of the core 44, that is to the shear line between the core 44 and the axial bore 38. Each of the first four radial bores 40 of the cylindrical body 30 contains a driver 60, as well as a spring 62 which backs the driver 60 and urges it toward the core 44. Hence, when the core 44 is rotated to the position in which bores 56 thereof align with the bores 38 of the body 30, the springs 62 in the first four bores 40 will urge the drivers 60 of those bores into the unoccupied portions of the corresponding radial bores 56 in the core 44 and thereby prevent the core 44 from rotating.

Figure 6:
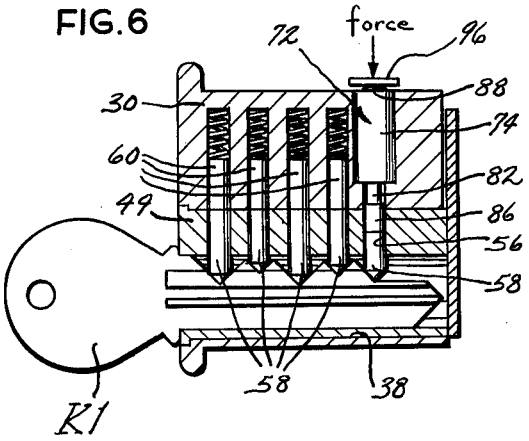
FIG. 6 is a sectional view of the lock cylinder with the first key inserted into the core and the push rod depressed.

The keyway 54 receives keys K1 and K2 (FIGS. 2, 6 and 7), each of which has cuts 64 which align with the radial bores 56 of the core 44 when either key K1 or K2 is fully inserted into the core 44. The first four cuts of the two keys K1 and K2 are identical and are located such that they will elevate the pins 58 of the first four bores to the shear line between the core 44 and the bore 38 into which it fits. Thus, when either key K1 or K2 is inserted into the keyway 54 of the core 44, the first four drivers 60, at least, will not restrict rotation of the core 44. The last cut on the key K2 likewise raises the pin 58 in the last radial bore 56 to the shear line (FIG. 7), but the last cut on the key K1 is somewhat deeper so that it is incapable of lifting the last pin 58 to the shear line (FIG. 6). The key K2 is considered a guide master key.

Figure 4:
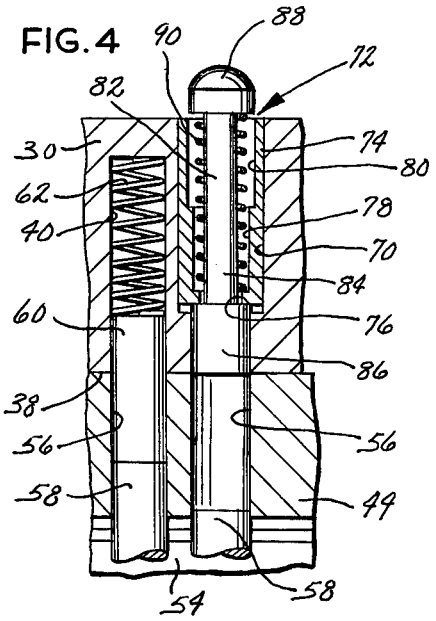
FIG. 4 is an enlarged sectional view of the lock cylinder at the push rod assembly therein with the push rod retracted.

The last radial bore 56 in the cylindrical body 30 is considerably shorter than the first four bores 56 (FIGS. 3 and 4). At its inner end, this bore 40 opens into the axial bore 38 of the body 30 at the shear line, just as the first four bores 40. However, its opposite end is not closed, but instead opens into an enlarged counterbore 70 which in turn opens out of the outer surface of the cylindrical body 30. The last bore 56 and counterbore 70 contain a push rod assembly 72 which provides the lock L with limited access capabilities.

Figure 5:
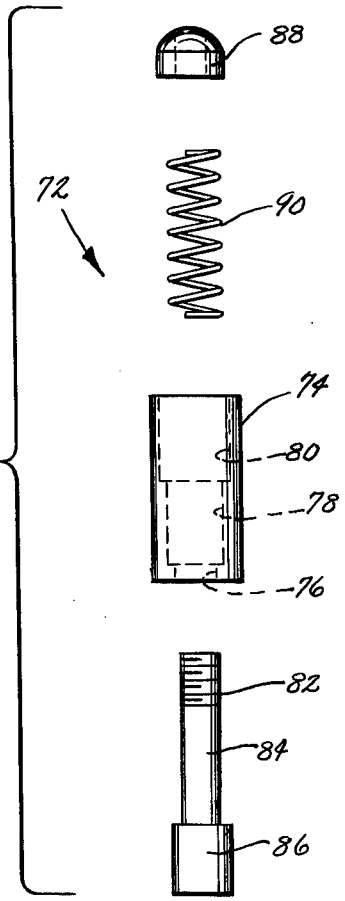
FIG. 5 is an exploded view of the push rod assembly.

The push rod assembly 72 (FIGS. 4 and 5) includes a sleeve 74 which fits snugly into the counterbore 70, it being secured firmly therein so that no movement will occur between the sleeve 74 and the cylindrical body 30. An adhesive may be used to achieve this end. Also, the attachment may be achieved by providing the sleeve 74 with external threads which mate with internal threads along the walls of the enlarged bore 72. The sleeve 74 contains an inner bore 76, an intermediate bore 78 into which the inner bore 76 opens, and an outer bore 80 into which the intermediate bore 78 opens. The inner bore 76 is located closest to the core 44 and opens toward the core 44. The outer bore 80 opens out of the opposite end of sleeve 76.

Extended through the aligned bores 76, 78, and 80 within the sleeve 74 is a push rod 82 (FIGS. 4 and 5) having an elongated shank 84 and an enlarged nose 86 at the end of the shank 84. The nose 86 is located beyond the inner end of the sleeve 74 and is disposed within the shortened last radial bore 40 of the body 30. Its diameter is the same as that of the pin 58 in the last radial bore 56 of the core 44. Hence, the nose 86 of the push rod 82 will drop into the last bore 56 of the core 44 and prevent rotation of the core 44 unless otherwise withheld. Nevertheless, the nose 86 is larger than the inner bore 76 within the sleeve 74, and this prevents the push rod 82 from being withdrawn through the sleeve 74. The shank 84 fits loosely through the inner bore 76 in the sleeve 74 and extends completely through the intermediate bore 78, terminating in the outer bore 80, which is the largest of the three bores in the sleeve 74. Here the end of the shank 84 is threaded and fitted with head 88 having a domed or rounded end facing outwardly. The diameter of the head 88 is slightly less than that of the outer bore 80 to enable the head 88 to slide freely into the outer bore 80. In this manner, the outer end of the push rod 82 is guided by the outer bore 80, while the inner end is guided by the inner bore 76 as well as the shortened last bore 40 within the body 30. The portion of the shank 84 located between the inner bore 80 and the head 88 is encircled by a coil-type compression spring 90 which is housed within the intermediate bore 78 and outer bore 80. The spring 90 urges the push rod 82 outwardly to a position in which the shoulder on the rear end of its nose 86 bears against the inner end of the sleeve 74 which serves as a limiting surface. When the push rod 82 is so disposed, the opposite end of the nose 86 must be precisely at the shear line between the core 44 and the axial bore 38 in the cylindrical body 30. If the nose 86 projects slightly into the bore 38, it will either enter the last radial bore 56 and prevent rotation of the core 44 or will bear against the outer surface of the core 44 and have a binding effect. On the other hand, if the nose 86 terminates short of the shear line, the pin 58 in the last bore 56 of the core 44 could rise into the corresponding bore 40 of the body 30 and prevent rotation of the core 44. The spring 90 normally prevents the nose 86 of the push rod 82 from dropping into the last radial bore 56 of the core 44 and preventing rotation of the core 44.

While it is important to have the lower end of the nose 86 on the push rod 82 precisely at the shear line between the core 44 and the axial bore 48, this does not present any difficulties during assembly of the cylinder C. If the sleeve 74 is secured by means of an adhesive, the core 44 is merely turned to take its radial bores 56 out of alignment with radial bore 40 of the body 30, and then the sleeve 74 is dropped into the enlarged counterbore 70 and urged downwardly to insure that the nose 86 of the push rod 82 is against the cylindrical surface of the core 44. This establishes the correct position for the sleeve 74. Thereafter, the adhesive is applied to secure the sleeve 74 permanently in that position. If the sleeve 74 is secured by means of threads on its external surface, then it is merely threaded into the enlarged bore 72 until the end of the nose 86 comes against the surface of the core 44.

When the push rod 82 is in its uppermost or normal position, the domed portion of its head 88 projects above the outer end of the sleeve 74 and also beyond the outer surface of the cylindrical body 30. The exposed head 88 is located opposite to and is moved by a bell crank 92 (FIG. 1) which is mounted in the case 16 of the lock L and pivots about a pin 94 located generally to the side of the cylinder C. The bell crank 92 has horizontal and vertical arms 96 and 98 which radiate from the pivot pin 94. The horizontal arm 96 extends over the cylinder C and has its free end located directly above the head 88 for the push rod 82 of the push rod assembly 72. The vertical arm 98 extends downwardly opposite the side of the cylinder C and has its free end connected to a solenoid actuator 100 which is attached to the case 16. Actually, the vertical arm 98 is connected to an iron core 102 of the solenoid actuator 100, which is spring loaded such that it is urged out of its coil. The arrangement is such that when the solenoid actuator 100 is de-energized the spring loading rotates the bell crank 92 backwardly enough to lift the horizontal arm 96 off of the head 88 of the push rod assembly 72. However, when the solenoid actuator 100 is energized, its core 102 is pulled inwardly, and this rotates the bell crank 92 forwardly, causing the end of the horizontal arm 96 to bear against the head 88 and push it downwardly. Since the head 88 is part of the push rod 82, the entire push rod 82 is driven downwardly, provided no obstruction exist, and the nose 86 thereon enters the last radial bore 56 in the core 44 (FIG. 6). As a result the push rod 82 prevents the core 44 from rotating. The bell crank 92, or at least one of its arms 96 or 98 is made from a resilient material such as spring steel. This enables core 102 of the solenoid to retract even though the push rod 82 may be blocked. In this case, the bell crank 92 merely deflects at its flexible portion.

The wires extending from the coil of the solenoid actuator 100 pass through the door D and lead to a control center located remote from the door D. The door may be mounted on the conductor hinge of U.S. Pat. No. 3,838,234 or the contact hinge of U.S. Pat. No. 3,659,063, with the circuit being completed through such a hinge.

OPERATION

The lock L is normally in a condition of limited access wherein it enables anyone having either the key K1 or the key K2 to open it (FIG. 3). In this condition, the solenoid actuator 100 is de-energized and the horizontal arm 96 is withdrawn slightly from the domed head 88 of the push rod 82 as a result of the bell crank having been rotated backwardly by the spring loading on the core 102 of the actuator 102. Thus, the nose 86 of the push rod 82 has its lower end located at the shear line between the core 44 and the axial bore 38.

Normally the drivers 60 in the cylindrical body 30 bridge the shear line and project partially into the first four radial bores 56. This prevents the core 44 from rotating. However, when the key K1 is inserted into the keyway 54 of the core 44, the pins 58 within the first four radial bores 56 are elevated to the shear line, and accordingly move the drivers 60 out of the bores 56. Moreover, the hose 86 of the push rod 82, like the drivers 60, is likewise located above the shear line. Consequently, the core 44 is free to turn, and may be rotated by the key K1.

The lock L may be rendered inoperative as to the key K1, merely by energizing the solenoid actuator 100. When this occurs, the bell crank 92 rotates forwardly and its horizontal arm 96 bears against the head 88 of the push rod 82, driving the push rod 82 downwardly and causing its nose 86 to enter the last radial bore 56 of the core 54 (FIG. 6). Consequently, the core 44 cannot be turned with the key K1. In this regard, it will be recalled that the last cut 64 on the key K1 is too deep to raise the pin 58 in the last bore 56 to the shear line. Hence, even when the key K1 is in the keyway 54, the last pin 58 does not prevent the nose 86 of the push rod 82 from entering the last bore 56. Of course, once the solenoid actuator 100 is deenergized, the bell crank 92 rocks backwardly, and the spring 90 pushes the push rod 82 upwardly to its withdrawn position wherein the lower end of the nose 86 is at the shear line.

Figure 7:
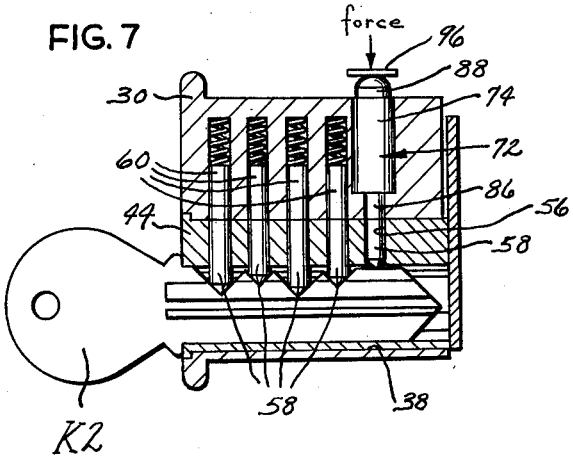
FIG. 7 is a sectional view similar to FIG. 6 but showing the second key in the core.

In contrast to the key K1, the key K2 has the capability of turning the core 44 even when the solenoid actuator 100 is energized. When the key K2 is inserted into the keyway 54 to its fullest extent, it raises all of the pins 58, including the pin 58 in the last bore 56, to the shear line of the core 44 (FIG. 7). In this regard, the key K2 must exert a sufficient force on the last pin 58 to enable it to force the nose 86 of the push rod 82 out of the last bore 56 and back into the bore 38 of the cylindrical body 30. While the key K2 does not exert sufficient force to overcome the force of the solenoid activator 100, the force exerted is nevertheless great enough to deflect the arm 96 or 98 of the bell crank 92 which is made from the flexible material. In others words, the bell crank 92 flexes to accommodate the withdrawl of the push rod 82 from the last radial bore 56 in the core 44. Thus, with the key K2 in the core 44, the core 44 may be rotated to retract the bolt 22 of the lock L. Hence, the key K2 is considered the master key.

With minor changes, the push rod 82 may be spring loaded inwardly and withdrawn against the spring loading by the solenoid actuator 100. In this case, the cylinder C would be operable by the key K1 only when the actuator 100 was energized.

This invention is intended to cover all changes and modifications of the example of the invention herein chosen for purposes of the disclosure which do not constitute departures from the spirit and scope of the invention.

What is claimed is:

1. In a lock including a case and a bolt in the case, improved key operated means for retracting the bolt on a selective basis, said means comprising: a member having a bore therein; a core in the bore and being capable of receiving a first key, the core having a hole therein; first means in the member for engaging the core and preventing the core from rotating when the key is out of the core and being disengaged from the core by the key when the key is inserted into the bore; second means engageable with the core for preventing rotation of the core irrespective of whether or not the first key is in the core, the second means including a push rod which will project into the hole of the core and prevent the core from rotating when the core is in the proper position of rotation and a spring urging the push rod away from the core; and actuating means for controlling the position of the push rod, the actuating means when energized overcoming the force exerted on the push rod by the spring and urging the push rod toward the core.

2. In a lock for securing a door or some other device and having the capability of being operated at selected times by a first key and at all times by a second key; the improvement comprising: a lock cylinder including a body member having a main bore, a core in the main bore and having a keyway and plurality of radial bores which extend between the keyway and the outer surface of the core, the keyway being configured to receive both the first and second keys, the radial bores of the core aligning with the radial bores of the body member when the core is in the proper position of rotation, drivers in some of the radial bores for the body member, a push rod in at least one of the radial bores for the body member and having a nose portion at its inner end, the nose portion being sized to fit into that radial bore of the core with which its own radial bore aligns, the outer end of the push rod being exposed at the exterior surface of the body member so that the push rod may be forced inwardly, a spring urging the push rod outwardly away from the core, and pins in the radial bores of the core and being of lesser length than those radial bores so that the drivers and the nose of the push rod may enter the radial bores of the core and prevent the core from rotating, the pins associated with the drivers being of such length that the first and second keys will move them sufficiently to force the drivers out of the core, the pin associated with the push rod being of sufficient length to drive the push rod out of the core when the second key is inserted into the core, but not when the first key is inserted into the core; a movable actuating element located externally of the lock cylinder and aligned with the outer end of the push rod, but being detached from the push rod; and means for moving the actuating element against the outer end of the push rod so as to urge the push rod toward the core.

3. The structure according to claim 2 and further comprising a guide for the push rod, the guide having a limiting surface thereon which blocks movement of the nose for the push rod away from the core when the inner end of the nose is flush with the surface of the main bore so that the pin which aligns with the push rod will not move into the bore for the push rod.

4. The structure according to claim 2 wherein the actuating element is sufficiently flexible to enable it to yield when the second key is inserted into the lock while the means for moving the actuating element urges the actuating element against the outer end of the push rod.

5. The structure according to claim 1 wherein both the first and second means are disengaged from the core when a second key is inserted into the core.

6. The structure according to claim 1 wherein the first means is disengaged from the core by both the first key and a second key and the push rod is disengaged from the core only by a second key.

7. The structure according to claim 2 and further comprising a pin in the hole of the core, the length of the pin being such that the second key will move the pin to a position flush with the outer surface of the core but the first key will not, whereby when the second key is in the core, the push rod will be incapable of entering the hole in the core, but when the first key is in the core, a portion of the hole remains unoccupied so that the push rod may project into this portion of the hole and prevent rotation of the core.

8. The structure according to claim 7 and further comprising limiting means for preventing the push rod from moving outwardly from the core beyond the position in which the inner end of the push rod is generally flush with the bore in which the core is located, whereby the driver cannot move into member and prevent rotation of the core.

9. The structure according to claim 8 wherein the actuating means comprises a remotely controlled actuator and a linkage between the actuator and the outer end of the push rod, the linkage being flexible so that it will deflect when the actuator is energized and the push rod is moved outwardly as a result of the second key being inserted into the core.

10. The structure according to claim 9 wherein the actuator is a solenoid.

11. A lock cylinder capable of being operated at selected times by a first key and at all times by a second key; said lock cylinder comprising: a body member having a main bore therein and plurality of radial bores opening into the main bore; a core in the main bore of body member and having a keyway and plurality of radial bores which extend between the keyway and the outer surface of the core, the keyway being configured to receive both the first and second keys, the radial bores of the core aligning with the radial bores of the body member when the core is in the proper position of rotation; drivers in some of the radial bores for the body member; a push rod in at least one of the radial bores for the body member; pins in the radial bores of the core and being of lesser length than those radial bores so that the drivers and push rod may enter the radial bores of the core and prevent the core from rotating, the pins associated with the drivers being of such length that the first and second keys will move them sufficiently to move the drivers out of the core, the pin associated with the push rod being of sufficient length to drive the push rod out of the core when the second key is inserted into the core, but not when the first key is inserted into the core; and limiting means for preventing the push rod from being urged outwardly beyond the position in which its inner end is flush with the main bore of the body member, whereby the pin in that radial bore of the core which is associated with the push rod will not enter the main body.

12. A lock cylinder according to claim 11 wherein the push rod is urged outwardly away from the core.

13. A lock cylinder according to claim 11 wherein the push rod has a shank and an enlarged nose at the end of the shank, the nose being presented toward the core; and wherein the limiting means comprises a sleeve in the body member and having the shank of the push rod extended through it but not the nose, the sleeve being positioned such that the one end of the nose bears against the end of the sleeve when the other end is flush with the surface of the main bore.

* * * * *